US010876549B2

(12) United States Patent
Duong et al.

(10) Patent No.: US 10,876,549 B2
(45) Date of Patent: Dec. 29, 2020

(54) TANDEM STATORS WITH FLOW RECIRCULATION CONDUIT

(71) Applicant: PRATT & WHITNEY CANADA CORP., Longueuil (CA)

(72) Inventors: Hien Duong, Mississauga (CA); Vijay Kandasamy, T. Palur (IN)

(73) Assignee: PRATT & WHITNEY CANADA CORP., Longueuil (CA)

( * ) Notice: Subject to any disclaimer, the term of this patent is extended or adjusted under 35 U.S.C. 154(b) by 7 days.

(21) Appl. No.: 16/376,416

(22) Filed: Apr. 5, 2019

(65) Prior Publication Data

US 2020/0318492 A1 Oct. 8, 2020

(51) Int. Cl.

| | |
|---|---|
| ***F04D 29/68*** | (2006.01) |
| ***F01D 17/12*** | (2006.01) |
| ***F04D 27/00*** | (2006.01) |
| *F01D 9/06* | (2006.01) |

(52) U.S. Cl.

CPC ..... *F04D 29/685* (2013.01); *F01D 17/12* (2013.01); *F04D 27/009* (2013.01); *F01D 9/065* (2013.01); *F05D 2220/3216* (2013.01); *F05D 2260/60* (2013.01)

(58) Field of Classification Search

CPC ..... F04D 27/009; F04D 29/685; F01D 9/065; F01D 9/06; F01D 17/12; F02B 37/02

USPC ..... 415/58.4, 58.5, 58.7, 57.1

See application file for complete search history.

(56) References Cited

U.S. PATENT DOCUMENTS

| | | | | |
|---|---|---|---|---|
| 4,349,314 | A | 9/1982 | Erwin | |
| 5,282,718 | A | 2/1994 | Koff et al. | |
| 5,340,271 | A | 8/1994 | Freeman et al. | |
| 5,431,533 | A | 7/1995 | Hobbs | |
| 5,607,284 | A | 3/1997 | Byrne et al. | |
| 6,099,245 | A * | 8/2000 | Bunker | F01D 5/146 415/115 |
| 6,220,012 | B1 | 4/2001 | Hauser et al. | |
| 6,390,418 | B1 | 5/2002 | McCormick et al. | |
| 6,554,569 | B2 | 4/2003 | Decker et al. | |
| 6,585,479 | B2 | 7/2003 | Torrance | |

(Continued)

FOREIGN PATENT DOCUMENTS

| | | |
|---|---|---|
| CN | 101418808 A | 4/2009 |
| CN | 102852644 B | 8/2016 |

(Continued)

*Primary Examiner* — Kenneth Bomberg
*Assistant Examiner* — Michael L Sehn
(74) *Attorney, Agent, or Firm* — Norton Rose Fulbright Canada LLP

(57) ABSTRACT

A method of operating a compressor of a gas turbine engine is described which includes directing a main airflow through tandem stator rows in a gaspath of the compressor, extracting a first portion of the main airflow from a first location proximate radially inner roots of stators of the first or second stator rows, extracting a second portion of the main airflow from a second location proximate the radially inner roots of the stators of the first or second stator rows, the second location being downstream of the first location relative to the main airflow, and re-injecting the combined extracted flow back into the main airflow at a third location. The third location is located upstream of the first and second locations, and is upstream of a leading edge of stators of the first stator row.

26 Claims, 5 Drawing Sheets

(56) References Cited

U.S. PATENT DOCUMENTS

| | | | | |
|---|---|---|---|---|
| 6,663,346 | B2 | 12/2003 | Munsell et al. | |
| 6,935,833 | B2 | 8/2005 | Seitz | |
| 7,074,006 | B1 | 7/2006 | Hathaway et al. | |
| 7,077,623 | B2 | 7/2006 | Guemmer | |
| 7,200,999 | B2 | 4/2007 | Bagnall et al. | |
| 7,320,575 | B2 | 1/2008 | Wadia et al. | |
| 7,445,426 | B1 * | 11/2008 | Matheny | F01D 9/042 415/135 |
| 7,553,122 | B2 | 6/2009 | Kirtley | |
| 7,802,760 | B2 | 9/2010 | Webster | |
| 7,811,049 | B2 | 10/2010 | Xu | |
| 8,043,046 | B2 | 10/2011 | Guemmer | |
| 8,082,726 | B2 | 12/2011 | Cloft | |
| 8,162,591 | B2 | 4/2012 | Grauer | |
| 8,262,340 | B2 | 9/2012 | Guemmer | |
| 8,382,422 | B2 | 2/2013 | Guemmer | |
| 8,628,291 | B2 | 1/2014 | Hiller | |
| 8,683,811 | B2 | 4/2014 | Clemen et al. | |
| 8,746,624 | B2 | 6/2014 | Birkenstock | |
| 8,904,747 | B2 | 12/2014 | Arar et al. | |
| 8,959,926 | B2 | 2/2015 | Bil et al. | |
| 9,206,744 | B2 | 12/2015 | Maldonado et al. | |
| 9,567,942 | B1 | 2/2017 | Krivitzky et al. | |
| 9,587,509 | B2 | 3/2017 | Guemmer | |
| 9,638,050 | B2 | 5/2017 | Takeda et al. | |
| 9,664,204 | B2 | 5/2017 | Guemmer | |
| 9,777,633 | B1 | 10/2017 | Nestico et al. | |
| 9,822,792 | B2 | 11/2017 | Guemmer | |
| 9,850,913 | B2 | 12/2017 | An et al. | |
| 10,041,500 | B2 | 8/2018 | Streit | |
| 10,047,620 | B2 | 8/2018 | Giacche et al. | |
| 10,072,522 | B2 | 9/2018 | Nolcheff et al. | |
| 10,227,930 | B2 | 3/2019 | Saxena et al. | |
| 10,415,478 | B2 | 9/2019 | Schwarz et al. | |
| 10,519,976 | B2 | 12/2019 | Shimo | |
| 2005/0226717 | A1 * | 10/2005 | Xu | F04D 29/684 415/58.5 |
| 2005/0235649 | A1 | 10/2005 | Baer et al. | |
| 2006/0018753 | A1 | 1/2006 | Menian | |
| 2015/0300254 | A1 | 10/2015 | Stretton | |
| 2017/0009663 | A1 | 1/2017 | Epstein | |
| 2017/0159667 | A1 * | 6/2017 | Streit | F04D 29/545 |
| 2017/0248155 | A1 | 8/2017 | Parker et al. | |
| 2017/0268409 | A1 | 9/2017 | Thomassin et al. | |
| 2017/0321606 | A1 | 11/2017 | Soltysiuk et al. | |
| 2018/0066536 | A1 | 3/2018 | Scholtes et al. | |
| 2018/0119619 | A1 | 5/2018 | Watson et al. | |
| 2018/0195408 | A1 | 7/2018 | Crall et al. | |
| 2018/0195528 | A1 | 7/2018 | Shimo | |
| 2018/0347401 | A1 | 12/2018 | Nolcheff et al. | |
| 2019/0078516 | A1 | 3/2019 | Sampath et al. | |

FOREIGN PATENT DOCUMENTS

| | | | |
|---|---|---|---|
| CN | 103620225 | B | 2/2017 |
| DE | 102018108940 | | 10/2019 |
| EP | 1832717 | A1 | 9/2007 |
| EP | 3081779 | A1 | 10/2016 |
| EP | 2044293 | B1 | 6/2018 |
| EP | 2833001 | B1 | 11/2018 |
| EP | 3483412 | | 5/2019 |
| GB | 2406139 | A | 3/2005 |
| GB | 2407142 | B | 3/2006 |
| GB | 2566956 | | 4/2019 |
| IN | 235854 | B | 9/2009 |
| IN | 201644040863 | A | 6/2017 |
| JP | 05490338 | B2 | 5/2014 |
| JP | 06185783 | B2 | 8/2017 |

* cited by examiner

TANDEM STATORS WITH FLOW RECIRCULATION CONDUIT

TECHNICAL FIELD

The application relates generally to gas turbine engines and, more particularly, to recirculating flow systems for the compressors of such engines.

BACKGROUND

Tandem stators (i.e. two stator rows located in immediate succession) are sometimes used in compressors with very high pressure ratios, when high flow turning and/or high Mach number flow is required. However, when such compressors are operating at off-design conditions, there can be large distortions in the flow at the inlet to the first stator and/or downstream of the compressor rotor.

Obtaining an acceptable performance and operating range from tandem stator designs can therefore be challenging, given that physical constraints on engine weight and overall compressor length can impose restrictions on stator length, number of stators, gas path size/shape, etc.

SUMMARY

There is accordingly provided a method of operating a compressor of a gas turbine engine comprising: directing a main airflow through tandem stator rows in a gaspath of the compressor, the tandem stator rows including a first stator row located upstream of a second stator row; extracting a first portion of the main airflow from a first location proximate radially inner roots of stators of the first or second stator rows; extracting a second portion of the main airflow from a second location proximate the radially inner roots of the stators of the first or second stator rows, the second location downstream of the first location relative to the main airflow; combining the first and second portions together to form a mixed recirculation flow; and re-injecting the recirculation flow back into the main airflow at a third location, the third location upstream of the first and second locations and upstream of a leading edge of stators of the first stator row.

There is also provided a method of operating a compressor of a gas turbine engine, the compressor having a rotor and tandem stator rows downstream of the rotor, the method comprising: extracting air from a main airflow passing through the compressor, the extracting occurring at two different locations axially spaced from one another, a first location disposed upstream of a second location relative to the main airflow, the first and second locations disposed downstream of a leading edge of stators of an upstream stator row of the tandem stator rows and disposed upstream of a trailing edge of stators of a downstream stator row of the tandem stator rows; and re-injecting the air extracted from the first and second locations back into the main airflow at a location upstream of the leading edge of the upstream stators of the tandem stator rows.

There is further provided a compressor for a gas turbine engine comprising: a rotor rotatable about an axis, the rotor including a hub and fan blades protruding from the hub and extending through a gaspath passage; tandem stator rows located downstream of the rotor relative to a direction of airflow through the gaspath passage, the tandem stator rows including a first stator row located upstream of a second stator row, each of the first and second stator rows having stators with a vane airfoil extending through the gaspath passage from a radially inner root to a radially outer tip; and a flow recirculation system including a first extraction conduit, a second extraction conduit, and a recirculation conduit, the first extraction conduit extending from a first inlet opening in the gaspath passage to a junction, the first inlet opening located near the radially inner root of the stators of the first stator row, the second extraction conduit extending from a second inlet opening in the gaspath passage to the junction, the second inlet opening located near the radially inner root of the stators of the second stator row, the second inlet opening being downstream of the first inlet opening, and the recirculation conduit extending from the junction to an outlet opening in the gaspath passage, the outlet opening located upstream of the first and second inlet openings and upstream of a leading edge of the stators of the first stator row.

BRIEF DESCRIPTION OF THE DRAWINGS

Reference is now made to the accompanying figures in which.

DETAILED DESCRIPTION

Figure 1:
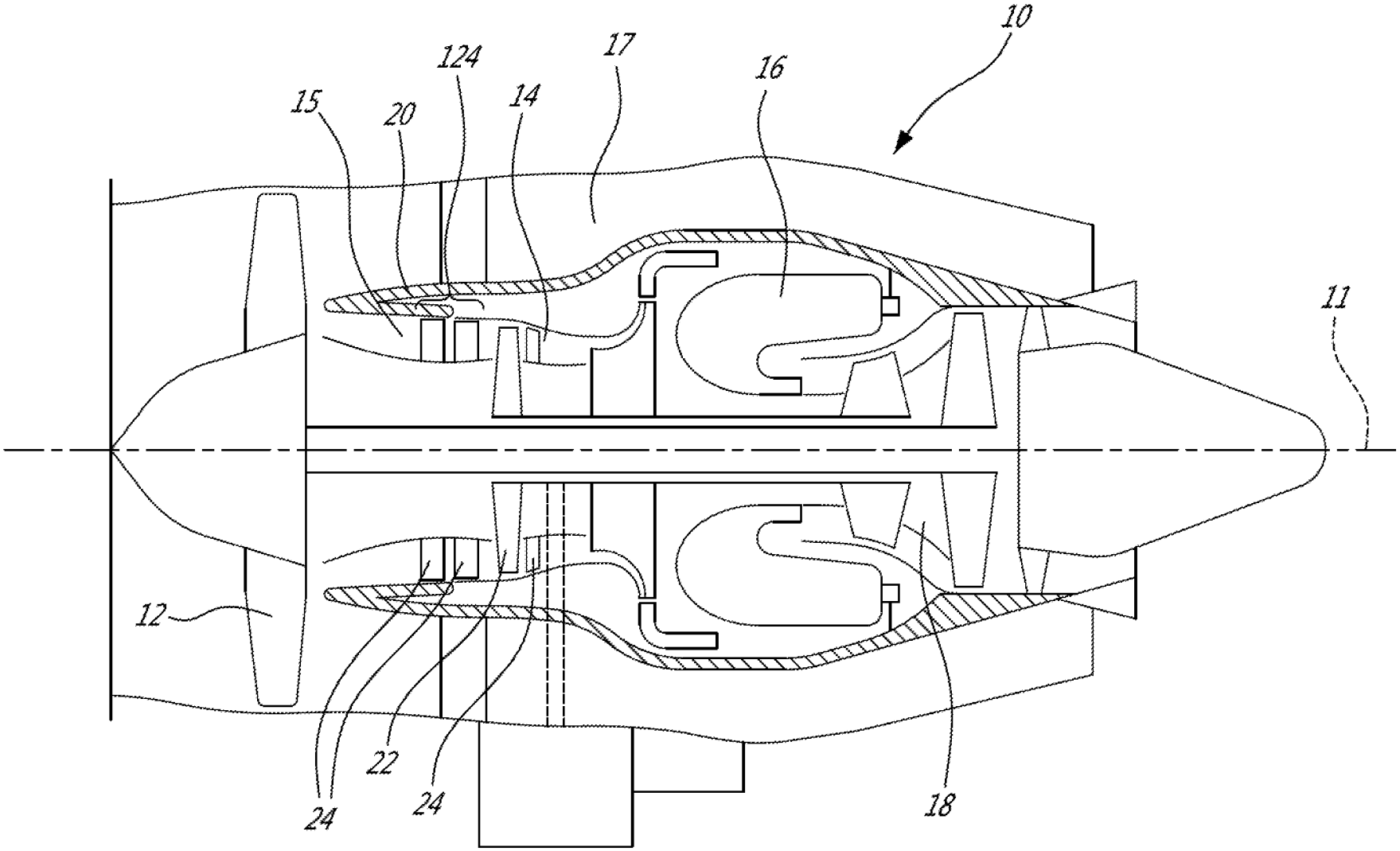
FIG. 1 is a schematic cross-sectional view of a gas turbine engine.

FIG. 1 illustrates a gas turbine engine 10 of a type preferably provided for use in subsonic flight, generally comprising in serial flow communication a compressor section 14 for pressurizing the air, a combustor 16 in which the compressed air is mixed with fuel and ignited for generating an annular stream of hot combustion gases, and a turbine section 18 for extracting energy from the combustion gases. The compressor section 14, and the turbine section 18 are rotatable about the axis 11.

The compressor section 14 includes one or more compressor rotors 12, 22 each having stators 24 downstream thereof. The exemplary gas turbine engine 10 of FIG. 1 is a turbofan engine, wherein the compressor 14 includes a fan assembly having a fan rotor 12 through which ambient air is propelled, before splitting between an engine core flow path 15 and a bypass flow path 17 downstream of the fan 12. The gas turbine engine 10 has an engine casing 20 that circumferentially extends around the axis 11. The core flow path 15 is therefore located radially inwardly of the engine casing 20 relative to the axis 11 and the bypass flow path 17 located radially outwardly of the engine casing 20 relative to the axis 11.

As will be described in further detail below, the compressor section 14 of the gas turbine engine 10 includes at least one compression stage having a tandem stator assembly 124 (which may be alternately referred to as a dual stator assembly), composed of two individual stators 24 in immediate flow-wise succession (i.e. without any rotor therebetween). In the embodiment depicted in FIG. 1, the tandem stator assembly 124 is shown as being part of the first compression stage, that is it is located downstream of the fan rotor 12 at the inlet of the core of the engine 10 and within the engine core flow path 15. It is to be understood, however, that the present tandem stator assembly 124 may form part of other compression stages, such as those further downstream within the core of the engine 10, either instead of or addition to being immediately downstream from the fan 12.

Figure 2:
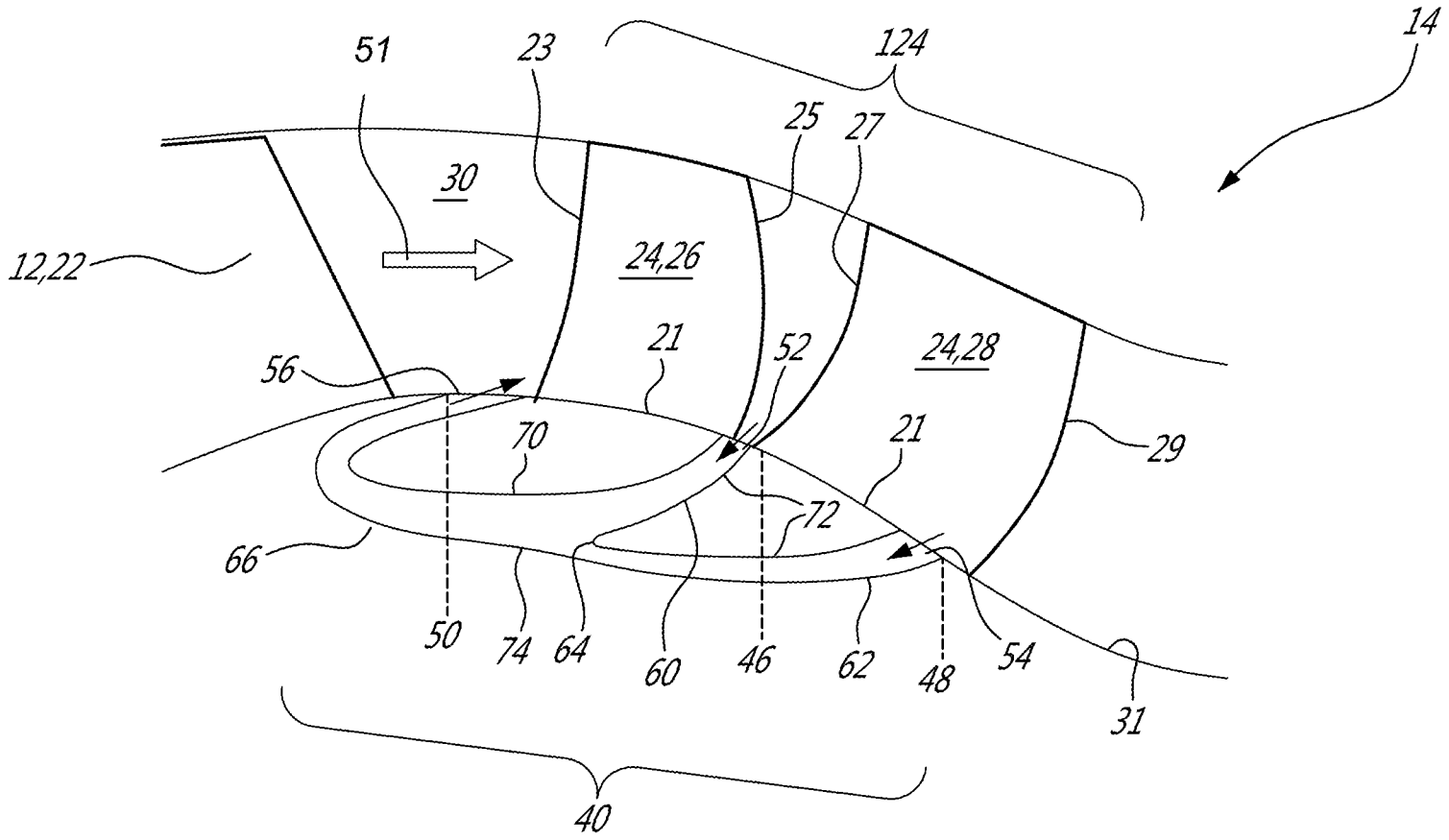
FIG. 2 is a schematic cross-sectional view of a portion of the compressor of the gas turbine engine of FIG. 1, showing the tandem stators and flow recirculation passages thereof.
Figure 3:
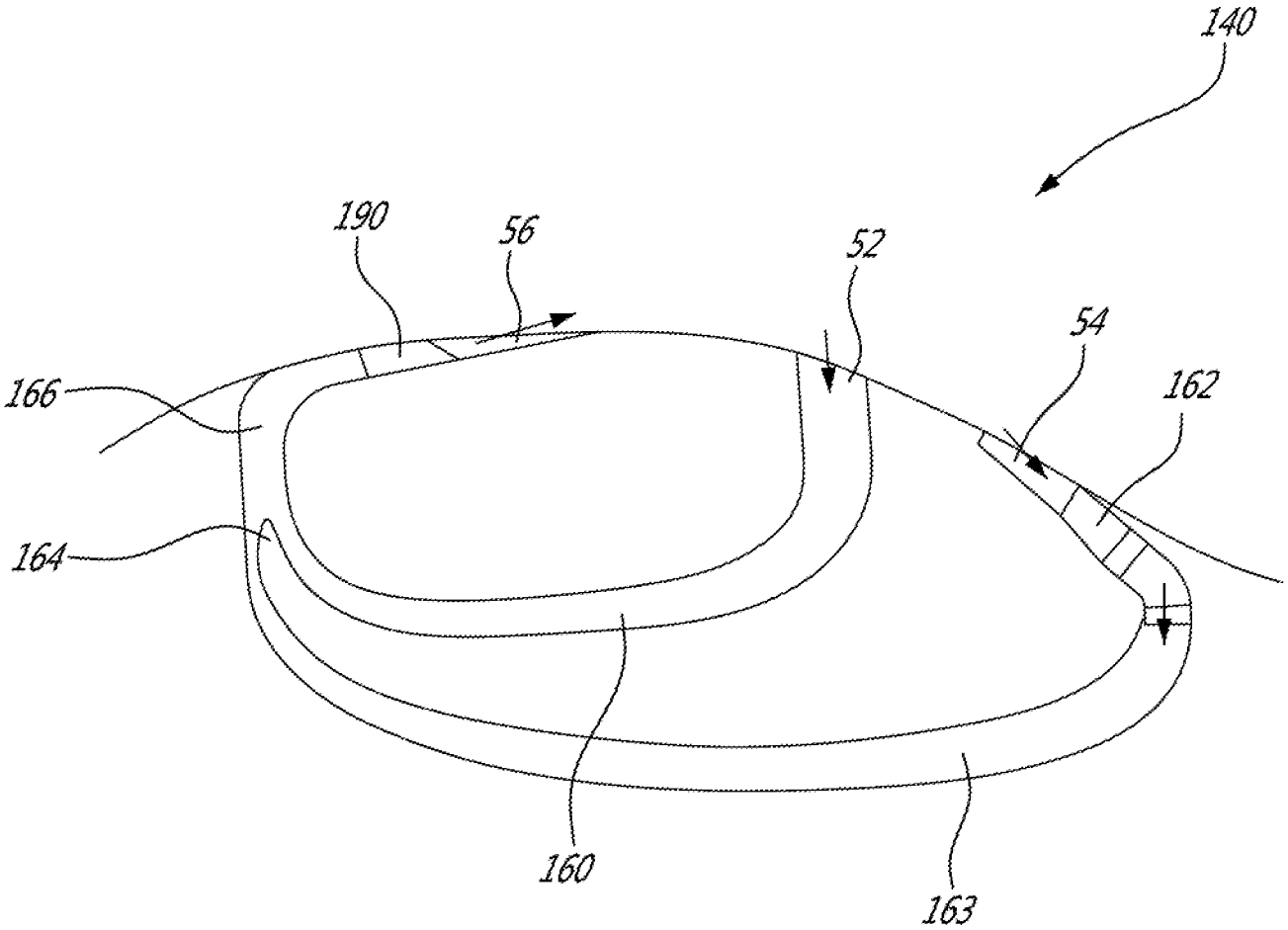
FIG. 3 is schematic cross-sectional view of the flow recirculation passage of the compressor of FIG. 2.
Figure 4:
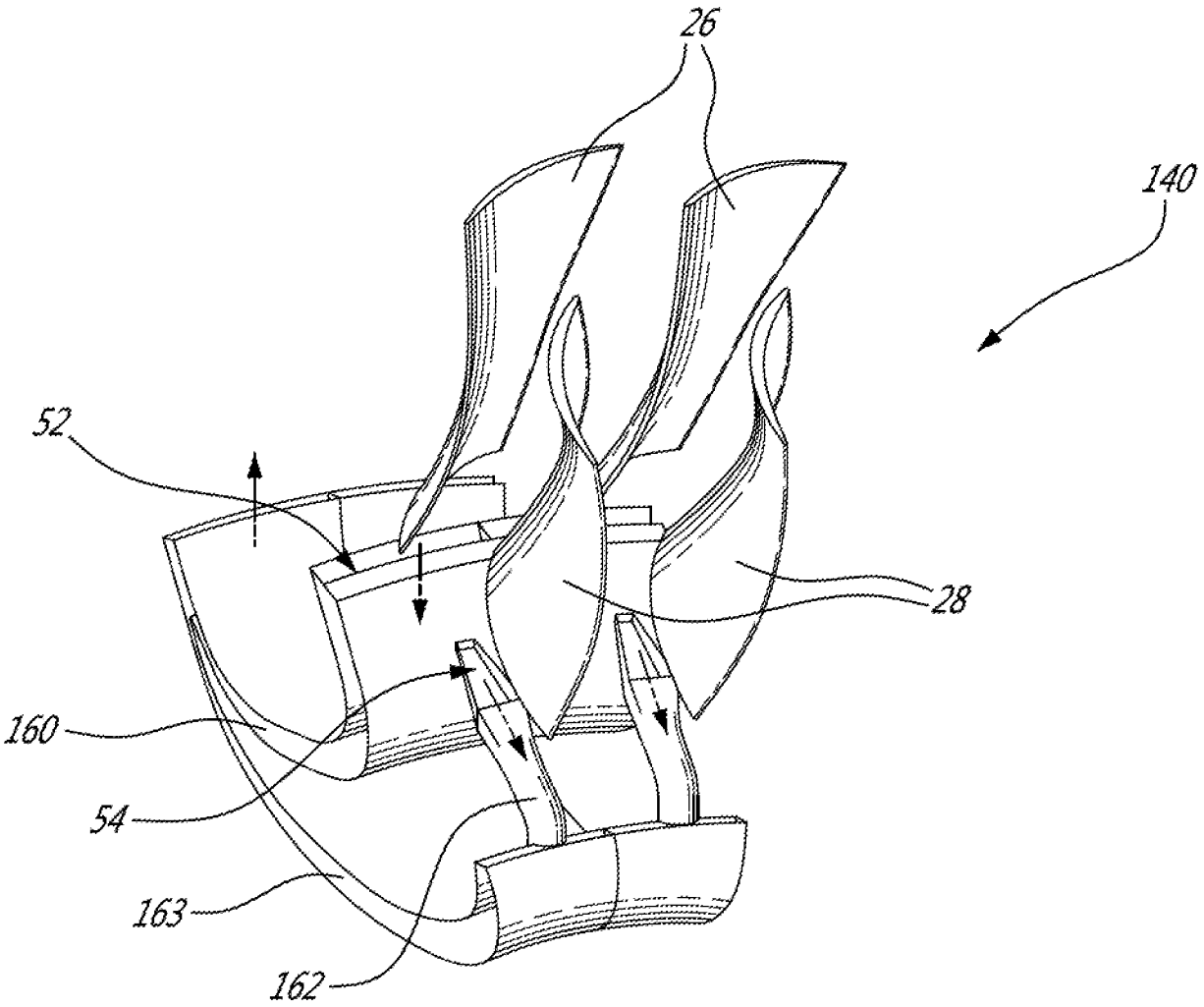
FIG. 4 is a partially cut-away, three-dimensional view of the compressor of FIG. 2, showing the tandem stators and the flow recirculation passages.

Referring now to FIGS. 2-4, the tandem stator assembly 124 includes a first, or upstream, stator row 26 and a second, or downstream, stator row 28. The first and second stator rows 26 and 28 are disposed within the main gaspath 30 of the compressor 14 downstream of a rotor, such as the fan 12 or a core engine compressor rotor 22. The first and second stator rows 26 and 28 are arranged in immediate flow-wise succession (i.e. without any rotor therebetween). The present compressor 14, or at least one compression stage of the compressor 14, is therefore said to be a dual stator or tandem stator compressor. Each of the first and second stator rows 26 and 28 comprises of a plurality of stators, which are circumferentially spaced apart about the annular pas passage and together form an annular array of stators that makes up each of the stator rows 26, 28. Although only one stator of the first stator row 26 and only one stator of the second stator row 28 are shown in the figures, it is to be understood that each of the stator rows comprises a plurality of individual stators. For the sake of simplicity, the exemplary stator of the first, upstream, stator row 26 will be simply referred to as the first stator 26, and the exemplary stator of the second, downstream, stator row 28 will be simply referred to herein as the second stator 28. Each of the stators of the stator rows extends from a radially inner end (or "root") to a radially outer end (or "tip"). For the avoidance of doubt, the radially inner ends of the stators will be generally referred to herein as the radially inner roots of the stators, which are proximate the radially inner platforms and radially inner walls of the annular gaspath through the compressor.

The terms "downstream" and "upstream" as used herein are all with reference to a direction of the main airflow through the main gaspath 30 of the compressor 14, that is the main airflow direction 51 in FIG. 2.

Referring to FIG. 2, the compressor 14 also includes a flow recirculation system 40 which is operable, as will be seen, to extract air from the main airflow flowing in the main airflow direction 51 through the main gaspath 30 of the compressor at two different locations 46 and 48 near the tandem stators 124 and then to re-inject the air extracted from these two different locations back into the main gaspath 30 at a location 50 disposed upstream of a leading edge 23 of the upstream stator 26. The present flow recirculation system 40 for a compressor having tandem stators 124 may accordingly help to improve the performance and/or or stall range of the compressor 14.

More particularly, a first inlet opening 52 and a second inlet opening 54 are disposed in the radially inner wall 31 of the main gaspath 30, proximate the radially inner roots 21 (or simply "roots") of the first and second stators 26 and 28. The first inlet opening 52 is located at the first location 46 and the second inlet opening 54 is located at the second location 48. As can be seen in FIG. 2, the first location 46 is disposed upstream of the second location 48, relative to the main airflow direction 51. As can also be seen in FIG. 2, both the first and second locations 46, 48, and therefore both the first inlet opening 52 and the second inlet opening 54, are located within the confines of the tandem stators 124. Stated differently, both the first and second locations 46, 48, and therefore both the first inlet opening 52 and the second inlet opening 54, are located downstream of a leading edge 23 of the first, or upstream, stator 26 and are located upstream of a trailing edge 29 of the second, or downstream, stator 28.

The first and second inlet openings 52 and 54 accordingly permit air to be extracted from the main airflow within the gaspath 30 at two different stream-wise locations, each of which will extract air at a different pressure.

Air extracted from the main airflow via the first inlet opening 52 feeds into a first conduit portion 60, which, in the exemplary embodiment of FIG. 2, extends radially inwardly and axially forwardly away from the first inlet opening 52 to a junction point 64 in the conduits of the of the flow recirculation system 40. Air extracted from the main airflow via the second inlet opening 54 feeds into a second conduit portion 62, which, in the exemplary embodiment of FIG. 2, extends radially inwardly and axially forwardly away from the second inlet opening 54 to the junction point 64. In the exemplary embodiment depicted in FIG. 2, the first conduit portion 60 has a greater radial component that an axial component (i.e. it extends radially inwardly more than it does axially forwardly), and conversely the second conduit portion 62 has a greater axial component than a radial component (i.e. it extends axially forwardly more than it does radially inwardly). However, it is to be understood that alternate configurations of these conduits are possible. The embodiment described above with respect to FIG. 2 is but one possible configuration of the, size, length, direction and orientation, etc. of each of the conduits. The axial and radial directions in these regards are understood to mean relative to the longitudinal axis 11 of the engine 10. Similarly, forward and rearward as used herein are understood to mean with refers to a forward end of the engine 10 and a rear end thereof.

The first conduit portion 60 and the second conduit portion 62 therefore meet at the junction 64 such that a first portion of the main gas flow which is extracted through the first conduit portion 60 and a second portion of the main gas flow which is extracted through the second conduit portion 62 meet at this junction 64. These two extracted airflows therefore combine and mix together at or immediately downstream of the junction 64. However, the air extracted via the second inlet opening 54 will have a greater initial pressure that the air extracted via the first inlet opening 52, given that the second inlet opening 54 is further downstream within the compressor than the first inlet opening 52. Accordingly, in order to maximize the efficiency of the extraction flow through both the first and second conduit portions 60 and 62 in at least the depicted embodiment the first conduit portion 60 is a diverging passage and the second conduit portion 62 is a converging passage. A cross-sectional area of the first conduit 60 at the junction point 64 is therefore greater than a cross-sectional area of the first inlet opening 52 which feeds the first conduit 60. Conversely, a cross-sectional area of the second conduit 62 at the junction point 64 is therefore smaller than a cross-sectional area of the second inlet opening 54 which feeds the second conduit 62. As such, the first portion of the main airflow which is extracted via the first inlet opening 52, and flows through the first conduit portion 60, is decelerated as it flows from the inlet opening 52 to the junction point 64, which thereby increases the pressure of this first extracted flow. Conversely, the second portion of the main airflow which is extracted via the second inlet opening 54 and flows through the second conduit portion 62, is accelerated as it flows from the second inlet opening 54 to the junction point 64, thereby decreasing the pressure of this second extracted flow. In a particular embodiment, the size, length and configurations of each of the first and second conduit portions 60 and 62 are chosen such that the pressure of the first and second extracted flows is substantially equal by the team the reach the junction point 64 and mix together. This may also help prevent any unwanted flow reversal within the conduits of the flow recirculation system 40 (which could happen if, for example, flow within one of the two passages 60 and 62 is significantly higher than the other, which might cause the flow to reverse directions in the lower pressured passage).

Once the air flows extracted through the first and second conduits 60 and 62 meet at the junction point 64, they combine together to form a mixed recirculation flow, which is then directed through a common recirculation conduit portion 66 that extends from the junction 64 to an outlet opening 56 formed in the radially inner wall 31 of the main gaspath passage 30. In the depicted embodiment, the recirculation conduit portion 66 converges from the junction point 64 to the outlet opening 56, thereby causing the mixed recirculation flow therein to accelerate and thus decrease in pressure. Accordingly, once the mixed recirculation flow reaches the outlet opening 56 it may have a pressure that is substantially the same or slightly greater than the pressure of the main airflow within the main gaspath at this specific location.

As noted above, the outlet opening 56 is located upstream of the leading edge 23 of the first stator 26, and the first and second inlet openings 52 and 54 are axially located between the leading edge 23 of the first, or upstream, stator 26 and the trailing edge 29 of the second, or downstream, stator 28.

In one particular embodiment, as depicted in FIG. 2, the first inlet opening 52, and therefore the first location 46, is disposed proximate the trailing edge 25 of the first stator 26, and the second inlet opening 54, and therefore the second location 48, is disposed between the leading edge 27 and the trailing edge 29 of the second stator 28. In a further embodiment, the second inlet opening 54, and thus the second location 48, is located between 25% and 60% of the cord length of the second stator 28. It is however to be understood that both the first and second inlet openings 52, 54 may be positioned in other axial locations, provided that the second inlet opening 54 remains downstream of the first inlet opening 52. Regardless of the position of the first and second inlet openings 52 and 54, the outlet opening 56 remains upstream of the leading edge 23 of the first, most upstream, stator 26.

It is to be understood that each of the first inlet opening 52, second inlet opening 54 and outlet opening 56 may in fact be composed of as few as one (e.g. a single annular slot) or as many as a plurality of separately formed holes or apertures in the inner wall 31. In one particular embodiment, as best seen in FIG. 4 for example, the first inlet opening 52 is formed as a single annular slot which extends 360 degrees about the compressor, thereby defining an annular gap in the radially inner wall 31 between the first and second stators 26, 28. In this same embodiment, the second inlet opening 54 is composed of a plurality of holes which are circumferentially spaced apart about the full circumference of the radially inner wall 31.

The first conduit portion 60, the second conduit portion 62 and the recirculation conduit portion 66, in one particular embodiment, together form a single flow passage or conduit which redirects flow extracted from the two different locations 48, 46 upstream to the common exit location 50 near the leading edge 23 of the first stator 26.

This reintroduced flow into the main gaspath may add additional momentum flow to re-energize the inlet end wall boundary layer, near the roots 21 of the stators at the radially inner side of the annular gaspath passage. Additionally, hub/root wake off the first stator 26 may also be reduced as a result of the re-introduced air, and secondary flow on the suction side of the second stator 28 may also be reduced and/or eliminated. End wall flow deficiencies, namely flow deficiencies which might otherwise form near the roots 21 of the stators 26, 28 of the compressor 14 may be reduced due to the flow re-injection at the exit location 50 as described above. This may be particularly useful at off-design conditions, when large deficiencies in pressure and/or flow can occur near the walls of main gas path through the compressor, particularly dual or tandem stator configurations (which are often optimized for a specific inlet Mach number and required flow turning conditions at the design point(s)).

In the embodiment of FIG. 2, this single flow passage formed by the respective conduit portions 60, 62 and 66 are composed of both stationary and rotating walls. More particularly, the radially outer walls 70 and 72, which at least partially define portions of all three conduit portions 60, 62 and 66, are stationary (i.e. no relative movement) relative to the radially inner wall 31 of the main gaspath passage. However, the radially inner wall 74, which extends from the second inlet opening 54 to the common outlet opening 56, rotates relative to the radially inner wall 31 of the main gaspath passage. The rotating radially inner wall 66 may form part of, or be attached to, the upstream rotor 12 or 22 of the compressor 14.

Referring now to FIGS. 3 and 4, a flow recirculation system 140 in accordance with an alternate embodiment is similar to the system 40 as described above, however with slightly different extracted air conduits. More particularly, air extracted from the main airflow at the first inlet opening 52 is directed through a much longer first conduit portion 160 before reaching the junction point 164 located more axially forward when compared to the position of the junction 64 of the system 40 described above. As can be best seen in FIG. 4, the first inlet opening 52 is a single annular slot. The second inlet openings 54, which in this embodiment are formed by a plurality of individual closed perimeter holes at the second location, feed the second stream of extracted air through tubular conduits 162 before being dumped into a common annular conduit portion 163 that extends axially forward to the junction point 164. This can be best appreciated in FIG. 4. After the two extracted airflows mix together at the junction 164, the resulting mixed recirculation flow is directed though the recirculation conduit 166 from to the exit opening(s) 56. As can be seen in FIG. 3, the recirculation conduit 166 extends substantially radially outwardly away from the junction 164 before bending back axially rearward to the exit opening(s) 56. In this particular embodiment, one or more small stator vanes 190 are disposed within the recirculation duct 166, between the junction 164 and the exit opening(s) 56. These small stator vanes 190 may help turn and/or straighten out the recirculation flow before it is re-injected back into the main gas flow of the compressor.

Figure 5:
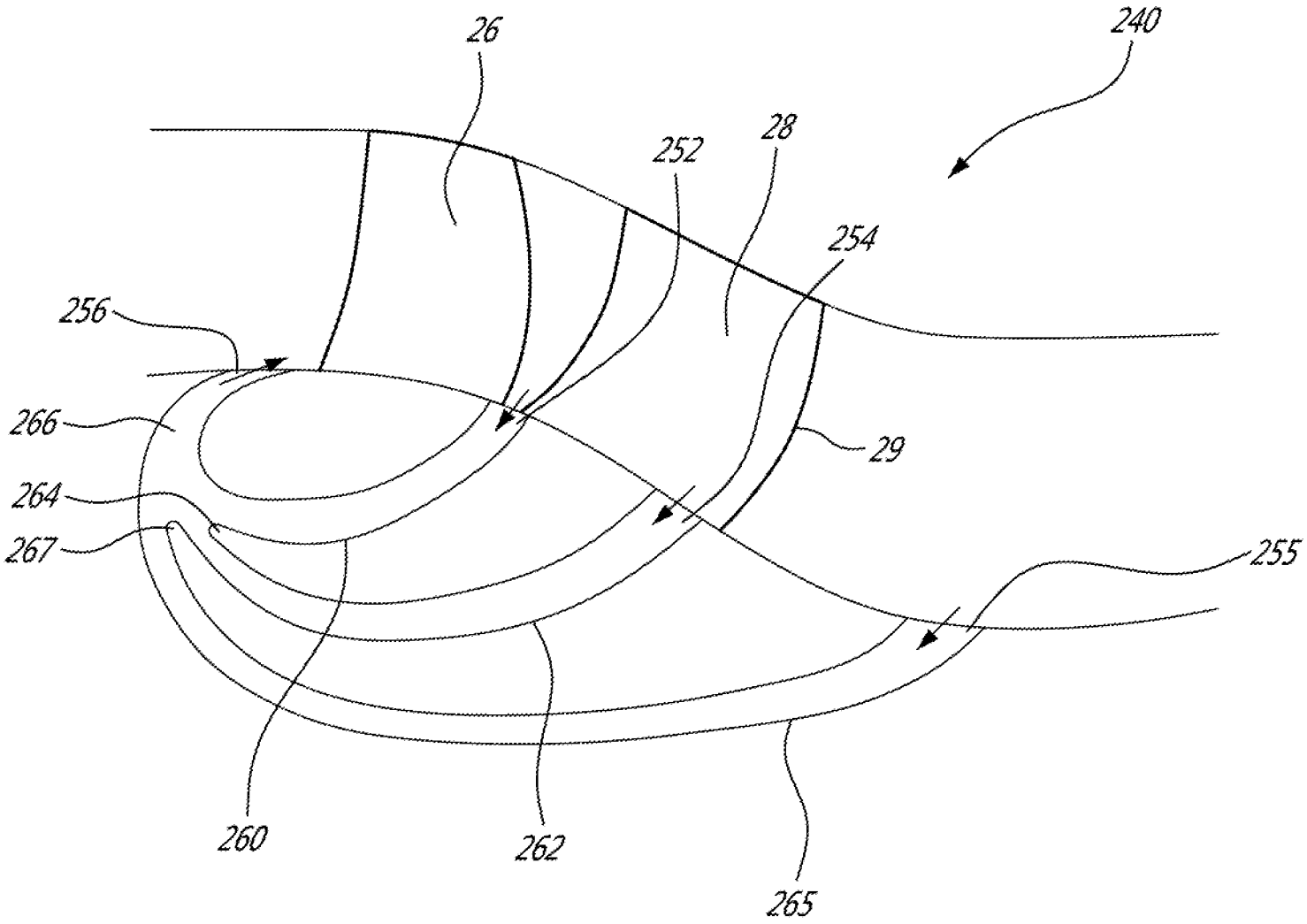
FIG. 5 is a schematic cross-sectional view of a portion of the compressor of the gas turbine engine of FIG. 1 in accordance with an alternate embodiment, showing the tandem stators and flow recirculation passages thereof.

Referring now to FIG. 5, a flow recirculation system 240 in accordance with another alternate embodiment is similar to the system 40 as described above, however this configuration provides more than two extractions from the main gas flow. More particularly, in this embodiment, a first inlet opening 252, a second inlet opening 254 and a third inlet opening 255, are provided. The first and second inlet openings 252 and 254 are much as per the first and second inlet openings 52 and 54 of the system 40 as described above. However, in this embodiment, at least a third inlet opening 255 is also provided, but located further downstream. More specifically, the third inlet opening 255 is located downstream of the trailing edge 29 of the second stator 28, and thus is located further downstream than the second inlet passage 254. This may further help to improve downstream performance of the compression stage. Given the addition of the third inlet opening 255, three inlet conduits are provided, namely a first conduit 260 that is fed air from the first inlet opening 252, a second conduit 262 that is fed air from the second inlet opening 254, and a third conduit 265 that is fed air from the third inlet opening 255. The first and second conduits 260 and 262 meet at a first junction 264, forming a first sub-stream, which then mixes with the extracted flow from the third conduit 265 at a second junction 267, to form a combined recirculation flow (fed by the three separate downstream sources). The combined recirculation flow then flows through the final recirculation duct portion 266 to reach the exit opening 256.

In this embodiment, the first conduit portion 260 is a diverging passage, the second conduit portion 262 is a converging passage, and the third conduit 265 is also converging. In order for the pressures of the three extracted flows to be substantially equal by the time they mix together at the junction points 264 and 267, the third conduit 265 may converge a greater extent than the second conduit portion 262 (i.e. flow in the third conduit is accelerated more than in the second conduit). Stated different, the pressure of the extracted flow increases more through the third conduit 265 than the second conduit 262.

The flow recirculation system 240 having an additional flow extraction further downstream may enable a shortened overall compressor duct and/or engine, thereby resulting in potential weight reduction.

As described herein, therefore, there is provided a method of extracting flow from the radially inner root of tandem stators, at two different locations, and recirculating the extracted flow upstream of first stator. There is also described a system that extracts air from two different locations within a tandem stator compressor configuration, one location being disposed further downstream (in the main gas path flow) relative to the other, and recirculating this extracted flow upstream for re-ingestion into the main gas path at a location upstream of the leading edge of the first stator (and therefore downstream of the trailing edge of the rotor located upstream of both stators. The method therefore extracts flow from the radially inner roots of tandem stators and recirculates this extracted flow to a location upstream of first stator.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A method of operating a compressor of a gas turbine engine comprising:

directing a main airflow through tandem stator rows in a gaspath of the compressor, the tandem stator rows including a first stator row located upstream of a second stator row;

extracting a first portion of the main airflow from a first location proximate radially inner roots of stators of the first or second stator rows;

extracting a second portion of the main airflow from a second location proximate the radially inner roots of the stators of the first or second stator rows, the second location downstream of the first location relative to the main airflow;

combining the first and second portions together to form a mixed recirculation flow; and re-injecting the recirculation flow back into the main airflow at a third location, the third location upstream of the first and second locations and upstream of a leading edge of stators of the first stator row.

2. The method of claim 1, wherein the first location is disposed proximate a trailing edge of the stators of the first stator row.

3. The method of claim 2, wherein the first location is disposed at or downstream of the trailing edge of the stators of the first stator row and upstream of a leading edge of the stators of the second stator row.

4. The method of claim 1, wherein the second location is disposed between a leading edge and a trailing edge of the stators of the second stator row.

5. The method of claim 1, further comprising directing the first portion though a first conduit extending from a first inlet opening at the first location to a junction, directing the second portion through a second conduit extending from a second inlet opening to the junction, the first and second conduits meeting at the junction to combining the first and second extracted portions together, and directing the recirculation flow from the junction to the third location via a single recirculation conduit.

6. The method of claim 1, further comprising increasing a pressure of the first portion after being extracted from the first location and before being re-injected into the main airflow at the third location.

7. The method of claim 1, further comprising decreasing a pressure of the second portion after being extracted from the second location and before being re-injected into the main airflow at the third location.

8. The method of claim 1, further comprising combining the first and second portions together to form the mixed recirculation flow when respective pressures of the first and second portions are substantially equal.

9. The method of claim 1, further comprising further comprising decreasing a pressure of the recirculation flow prior to reaching the third location.

10. A method of operating a compressor of a gas turbine engine, the compressor having a rotor and tandem stator rows downstream of the rotor, the method comprising:

extracting air from a main airflow passing through the compressor, the extracting occurring at two different locations axially spaced from one another, a first location disposed upstream of a second location relative to the main airflow, the first and second locations disposed downstream of a leading edge of stators of an upstream stator row of the tandem stator rows and disposed upstream of a trailing edge of stators of a downstream stator row of the tandem stator rows; and re-injecting the air extracted from the first and second locations back into the main airflow at a location upstream of the leading edge of the upstream stators of the tandem stator rows.

11. The method of claim 10, further comprising extracting the air from the main airflow at radially inner roots of stators of the tandem stator rows.

12. The method of claim 10, further comprising combining air extracted from the first and second locations together to form a recirculation flow, re-injecting the recirculation flow into the main airflow at said location upstream of the leading edge of the upstream stators of the tandem stator rows.

13. The method of claim 12, further comprising decreasing a pressure of the recirculation flow prior to reaching said location upstream of the leading edge of the upstream stators of the tandem stator rows.

14. The method of claim 10, wherein the first location is disposed proximate a trailing edge of the upstream stators of the tandem stator rows.

15. The method of claim 14, wherein the first location is disposed at or downstream of the trailing edge of the upstream stators and upstream of a leading edge of the downstream stators of the tandem stator rows.

16. The method of claim 10, wherein the second location is disposed between a leading edge and the trailing edge of the downstream stators of the tandem stator rows.

17. The method of claim 10, further comprising increasing a pressure of the air extracted at the first location before being re-injected into the main airflow at said location upstream of the leading edge of the upstream stators of the tandem stator rows.

18. The method of claim 10, further comprising decreasing a pressure of the air extracted at the second location before being re-injected into the main airflow at said location upstream of the leading edge of the upstream stators of the tandem stator rows.

19. A compressor for a gas turbine engine comprising: a rotor rotatable about an axis, the rotor including a hub and fan blades protruding from the hub and extending through a gaspath passage; tandem stator rows located downstream of the rotor relative to a direction of airflow through the gaspath passage, the tandem stator rows including a first stator row located upstream of a second stator row, each of the first and second stator rows having stators with a vane airfoil extending through the gaspath passage from a radially inner root to a radially outer tip; and a flow recirculation system including a first extraction conduit, a second extraction conduit, and a recirculation conduit, the first extraction conduit extending from a first inlet opening in the gaspath passage to a junction, the first inlet opening located near the radially inner root of the stators of the first stator row, the second extraction conduit extending from a second inlet opening in the gaspath passage to the junction, the second inlet opening located near the radially inner root of the stators of the second stator row, the second inlet opening being downstream of the first inlet opening, and the recirculation conduit extending from the junction to an outlet opening in the gaspath passage, the outlet opening located upstream of the first and second inlet openings and upstream of a leading edge of the stators of the first stator row.

20. The compressor of claim 19, wherein the first extraction conduit diverges from the first inlet opening to the junction.

21. The compressor of claim 19, wherein the second extraction conduit converges from the second opening to the junction.

22. The compressor of claim 19, wherein the recirculation conduit converges from the junction to the outlet opening.

23. The compressor of claim 19, wherein one or more of the first extraction conduit, the second extraction conduit and the recirculation conduit are defined between a radially outer fixed wall and a radially inner rotating wall.

24. The compressor of claim 19, wherein the first inlet opening is disposed proximate the trailing edge of the stators of the first stator row and upstream of a leading edge of the stators of the second stator row.

25. The compressor of claim 24, wherein the first inlet opening is disposed downstream of the trailing edge of the stators of the first stator row.

26. The compressor of claim 19, wherein the second inlet opening is disposed between a leading edge and a trailing edge of the stators of the second stator row.

* * * * *